US008720000B2

(12) United States Patent
Pedrazzini Bertolazzi

(10) Patent No.: US 8,720,000 B2
(45) Date of Patent: May 13, 2014

(54) VACUUM CLEANER WITH ADDITIONAL FUNCTIONS

(75) Inventor: Marino Pedrazzini Bertolazzi, Madigano (IT)

(73) Assignee: ITAL Research & Innovation S.R.L., Crema (CR) (IT)

( * ) Notice: Subject to any disclaimer, the term of this patent is extended or adjusted under 35 U.S.C. 154(b) by 665 days.

(21) Appl. No.: 12/374,834

(22) PCT Filed: Jul. 6, 2007

(86) PCT No.: PCT/IB2007/002014

§ 371 (c)(1),
(2), (4) Date: Jan. 23, 2009

(87) PCT Pub. No.: WO2008/012620

PCT Pub. Date: Jan. 31, 2008

(65) Prior Publication Data

US 2009/0313785 A1 Dec. 24, 2009

(30) Foreign Application Priority Data

Jul. 24, 2006 (IT) ..... CR2006A0018

(51) Int. Cl.
*A47L 9/00* (2006.01)
*A47L 9/22* (2006.01)

(52) U.S. Cl.
USPC ..... 15/339

(58) Field of Classification Search
USPC ..... 15/320, 321, 345, 346, 339, 412
See application file for complete search history.

(56) References Cited

U.S. PATENT DOCUMENTS

| | | | | |
|---|---|---|---|---|
| 4,789,310 | A | 12/1988 | Hung | |
| 4,799,280 | A * | 1/1989 | Lee | 15/29 |
| 5,688,055 | A * | 11/1997 | Kondou et al. | 384/449 |
| 5,784,754 | A * | 7/1998 | Roden et al. | 15/320 |
| 6,351,870 | B1 * | 3/2002 | Moritsch | 15/321 |
| 2003/0129065 | A1 * | 7/2003 | Hu | 417/234 |

FOREIGN PATENT DOCUMENTS

| | | |
|---|---|---|
| DE | 08-275912 | 10/1996 |
| EP | 0 252 265 | 1/1988 |
| GB | 2 199 653 | 7/1988 |

OTHER PUBLICATIONS

International Search Report dated Nov. 16, 2007 from corresponding PCT application.

* cited by examiner

*Primary Examiner* — Robert Scruggs
(74) *Attorney, Agent, or Firm* — Young & Thompson

(57) ABSTRACT

Vacuum cleaner including a container (1, 101) provided with a suction mouth (8, 108), motor elements (2, 20) and at least one suction fan (3, 103), in which the vacuum cleaner includes at least one additional machine (4, 10, 104) connected to the motor elements through transmission elements (7, 11) that can be activated selectively. A particularly preferred application has a 'canister' type of vacuum cleaner that additionally includes a high-pressure pump unit, fitted on the opposite side to the vacuum cleaner fan or on the same side, in axis or off axis, and driven by the motor by an idle gear and a speed reduction unit.

15 Claims, 3 Drawing Sheets

VACUUM CLEANER WITH ADDITIONAL FUNCTIONS

SUMMARY OF THE INVENTION

The present invention relates to a vacuum cleaner equipped with additional functions, for example designed to work also as a high-pressure pump, compressor, etcetera.

Conventional vacuum cleaners, as is known, essentially comprise a container for a vacuum created by an electric motor that drives a suction fan, also called "turbine," and possibly a cooling fan.

The object of the present invention is to add additional functions to a vacuum cleaner, creating a multipurpose machine for household, semi-professional or professional users.

The object is achieved with a vacuum cleaner comprising a container with a vacuum created by motors means and at least one suction fan, characterized in that it comprises at least one additional machine connected to said motors means through transmission means that can be activated selectively.

The term motors is used to mean any known motor or combination of motors, such as electric motors, internal combustion engines, two or four stroke engines, etc . . . or an internal combustion engine with an electric generator.

The term additional machine means any machine or device of a known type. The additional function preferably consists in a high-pressure pump (pressure cleaner) and/or an air compressor and/or a machine tool (e.g., a grinding machine).

The means of transmission that can be selectively activated consist, preferably, in idle gear bearings or clutches with a magnetic coupling or a mechanical coupling by centrifugal force.

The idle gear bearings are advantageous when it is possible to reverse the direction of rotation of the motor, that therefore is the electric or two stroke type; the use of clutches in place of the idle gears is advantageous, instead, with a four-stroke engine that can be started in one direction only. This does not mean that magnetic or mechanical clutches cannot be used with electric motors or two-stroke engines too.

A particularly preferred application has a "canister" type of vacuum cleaner that additionally comprises a high-pressure pump unit, fitted on the opposite side to the vacuum cleaner fan or on the same side, in axis or off axis, and driven by the motor by an idle gear and a speed reduction unit, as will be better illustrated hereunder.

Another preferred embodiment has, in addition to the vacuum cleaner, a compressor and a compressed air reservoir or cylinder that can be detached from the main unit, for handier use.

Another embodiment has a high-pressure pump unit and a compressor that are fitted on the same vacuum cleaner.

BRIEF DESCRIPTION OF THE DRAWINGS

Characteristics and advantages of the invention will be clearer with the help of the following description and the attached figures, in which.

DETAILED DESCRIPTION OF THE PREFERRED EMBODIMENTS

Figure 1:
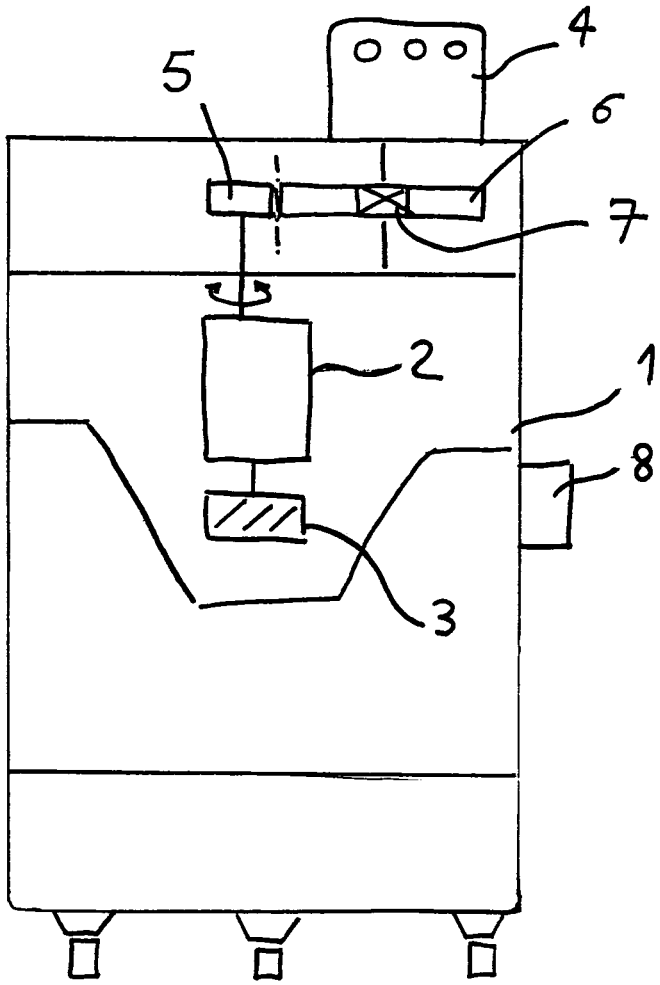
FIGS. 1, 2 and 3 represent functional diagrams, by way of example, of a vacuum cleaner modified according to the invention.

Referring to the diagram of FIG. 1, a vacuum cleaner is illustrated that comprises a container or "canister" 1 inside which there is an electric motor 2 that drives at least one suction fan 3.

The motor 2, by means of an appropriate selector of a known type (not illustrated), can be started up in either direction of rotation.

Said motor 2 can operate also a high-pressure pump 4 of the piston and swash-plate type, via a selective type of transmission that, in the example, comprises a pinion 5 that engages a cogwheel 6 fitted on an idle gear bearing 7. The connection with the fan 3, on the contrary, is direct.

The pinion 5 and the wheel 6 produce a reduction in speed, since the electric motor 2 typically has a much higher speed of rotation than the rated speed of operation of the pump 4.

It is understood that, due to the presence of the idle gear 7, the pump 4 can be operated selectively, making the motor 2 start in one direction of rotation or in the other.

The drum 1 is of a type in itself known and it comprises a suction union 8, to which a pipe can be connected in order to use it as a vacuum cleaner.

Figure 2:
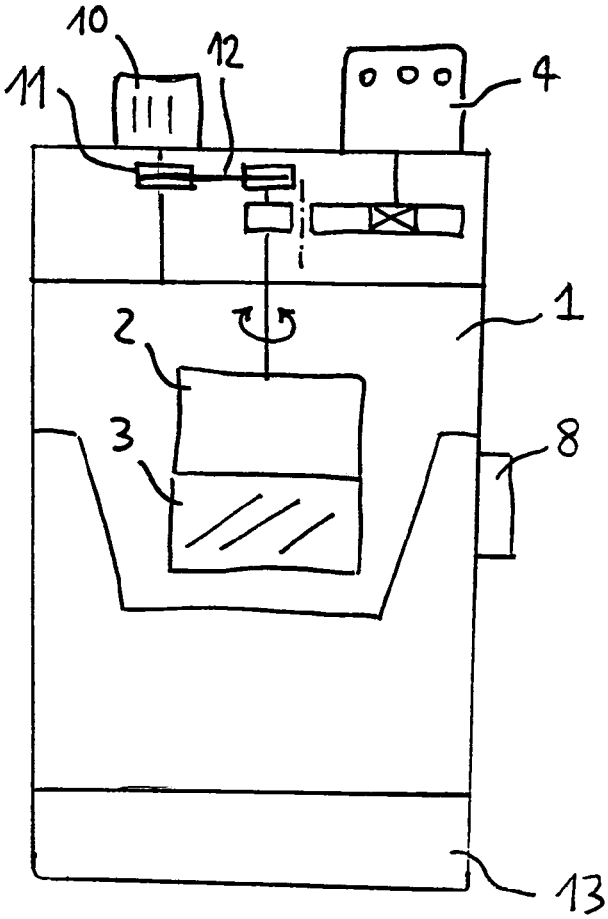

Referring to FIG. 2, an analogous embodiment is shown, that also comprises a compressor 10, besides the high-pressure pump 4.

Said compressor 10 is driven by the motor 2 by a magnetic clutch 11 and a belt 12. In particular, the magnetic clutch 11 is fitted in order to couple the shaft of the compressor with the driven pulley, which is connected to the driving pulley: this enables selectively engaging and disengaging the compressor 10.

The transmission between the motor and compressor can also be direct, via gears.

Advantageously, a reservoir or cylinder 13 is provided for the compressed air supplied by the compressor 10. Even more preferably, said reservoir 13 can be detached from the drum 1, so that the user can carry around a reserve of compressed air.

The inlet 8 is advantageously equipped with a valve that enables cutting off suction during operation as a compressor, which avoids losing power. The valve can be operated automatically (for example with a clapet) that automatically shuts off the inlet 8 on extracting the suction pipe, that is normally connected to said inlet. The valve can be provided with a narrow passage (e.g., a hole of diameter 8 mm) that lets a small amount of air enter to cool the motor even when the diaphragm of the valve is shut.

The same valve can be alternatively positioned at the end of the suction pipe or on the mouthpiece of the accessories with the activation system on the handgrip.

Figure 3:
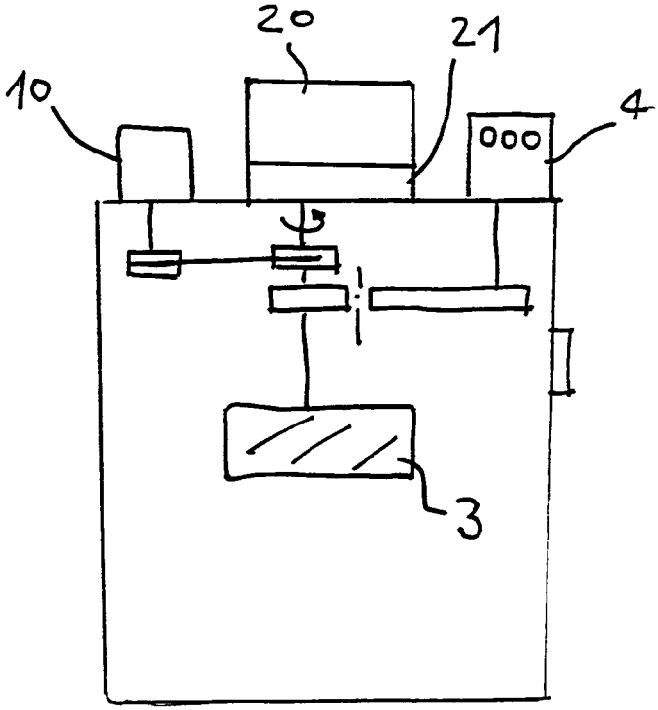

FIG. 3 illustrates an example of embodiment with a two or four stroke combustion engine. In this example of embodiment there is a combustion engine 20, that drives an electric generator 21 above or under said engine, always engaged. The engine 20 moreover drives the suction fan 3, pump 4 and compressor 10, in the manner described above.

With all types of engine (electric motor or combustion engine) it is possible to have either the arrangement of FIGS. 1-2 with the motor inside the drum 1 or the arrangement of FIG. 3 with the motor outside, above the drum. Any other equivalent arrangement of the mechanical members will in any case be able to be used by the sector technician.

Figure 4:
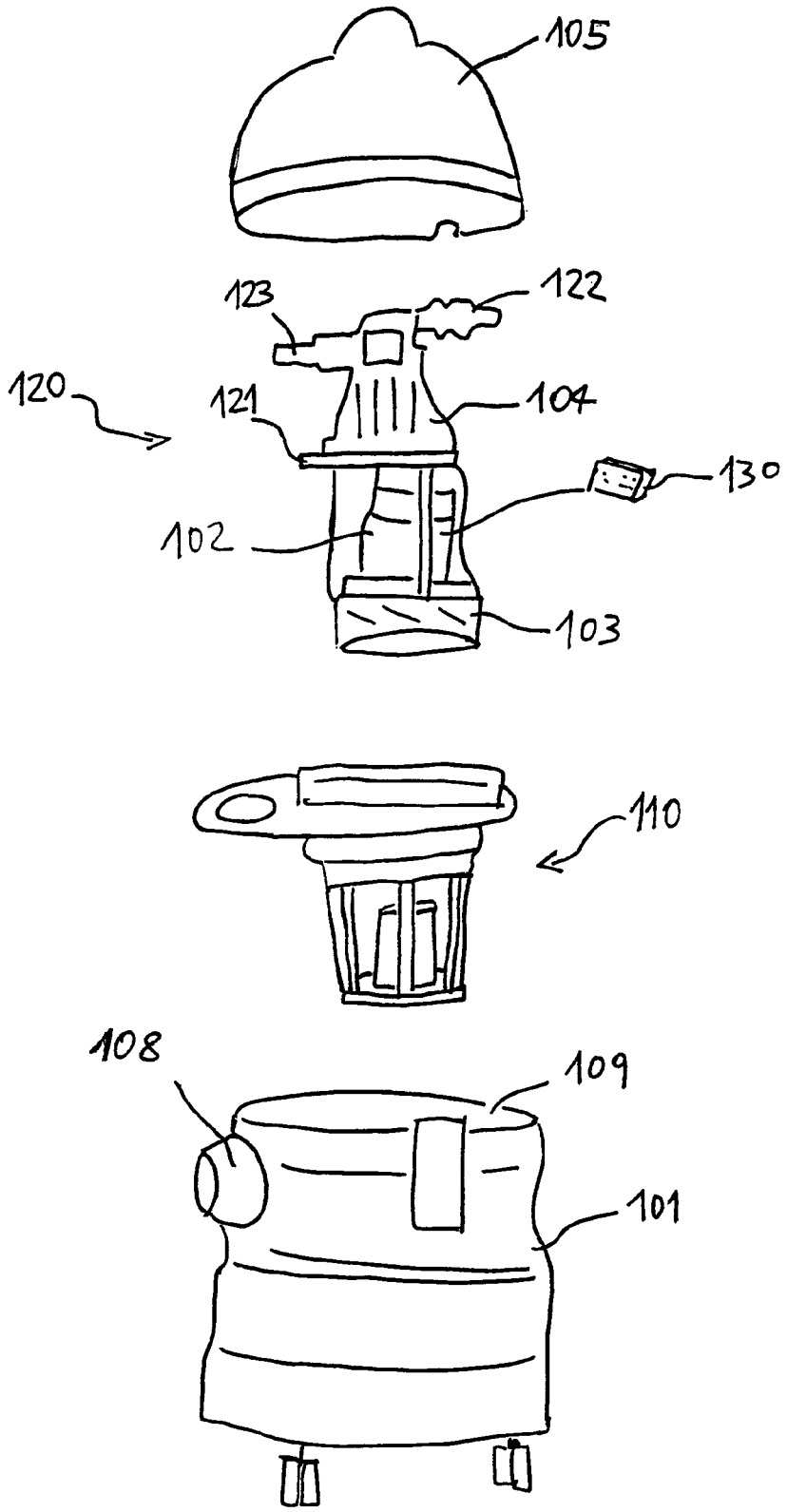
FIG. 4 shows an exploded view of a suction "canister" modified according to the invention, with the addition of a pressure cleaner.

FIG. 4 shows an example of application of the invention, that is substantially equivalent to the diagram of FIG. 1 and it involves modifying a known vacuum cleaner, of the "suction canister" type, by fitting a high-pressure pump. This produces a multipurpose vacuum cleaner/pressure cleaner machine.

More in detail, the machine comprises a drum or container 101 with a suction inlet 108 and a top mouth 109 where a cartridge 110 is inserted preferably of the "wet&dry" type.

The machine comprises an electric motor 102 coupled directly to a suction fan 103; the modification involves adding a high-pressure pump 104, from the opposite side of the fan 103 with respect to the motor, creating a suction-pump "unit" that as an assembly is indicated as 120.

It must be noted that said unit 120 is particularly compact being contained between the drum 101 and a cover 105, so that the complete machine substantially has the overall dimensions of a common "suction canister."

The reduction in speed and the idle gear bearing (numbers 5, 6 and 7 of FIG. 1) are substantially housed by the flange 121, that couples the electric motor 102 to the pump 104.

Said pump 104 has a mains water inlet 122 and an outlet for the pressurized water 123; preferably the pump is of the type with pistons and swash-plate.

The motor 102 is electrically connected to a selector 130 that allows reversing the direction of rotation and, via the idle gear bearing, operating the pump 104 selectively.

Basically, starting the motor in one direction provides operation as a vacuum cleaner, while the pump 104 stays stationary; starting the motor instead in the other direction the said pump 104 is also operated, having pressurized water for the most varied uses, while the fan 103 turns with no load.

In this case, in which there are only two operating machines and it is possible to reverse the direction of rotation, the presence of the valve is superfluous in the suction inlet 108.

All the additional machines are independent of each other and therefore the vacuum cleaner can be equipped with one or more of them according to need.

For reasons of space, if there are more than two operating machines added, the gears of the transmission system can be arranged along arcs of circumference rather than along a line.

It is clear that the application potential is not limited to the examples described and illustrated and in particular any motor and any combination of machines or devices of a known type can be used.

The invention claimed is:

1. A vacuum cleaner, comprising:

a container (1, 101) provided with a suction mouth (8, 108), reversible motor means (2, 20), and at least one suction fan (3, 103); and at least one additional machine (4, 10, 104) connected to said motor means through transmission means (7, 11), said transmission means configured to engage the motor means to the additional machine selectively, and said transmission means including a speed reduction unit to drive the additional machine, when engaged, at a speed less than a speed of the motor means, wherein said transmission means comprise at least one idle gear bearing (7) configured to transmit power from the motor means to the additional machine when the motor means rotates in a first direction, and configured to idle when the motor rotates in an opposite second direction.

2. The vacuum cleaner according to claim 1, wherein said motor means comprise an electric motor (2).

3. The vacuum cleaner according to claim 1, wherein said motor means comprise a combustion engine (20).

4. The vacuum cleaner according to claim 1, wherein said transmission means comprise at least one magnetic clutch (11).

5. The vacuum cleaner according to claim 1, wherein said transmission means comprise at least one mechanical clutch.

6. The vacuum cleaner according to claim 1, further comprising:

at least one high-pressure pump (4).

7. The vacuum cleaner according to claim 1, further comprising:

at least one air compressor (10).

8. The vacuum cleaner according to claim 7, further comprising:

a reservoir or cylinder (13) for compressed air, connected in a detachable way to said container (1).

9. The vacuum cleaner according to claim 1, further comprising:

a suction inlet (8) with a valve that enables shutting off the suction during the operation of said at least one additional machine.

10. The vacuum cleaner according to claim 1, wherein the idle gear bearing and speed reduction unit are included inside a housing.

11. The vacuum cleaner according to claim 1, wherein the at least one idle gear bearing has a cogwheel (6) mounted thereon, the cogwheel being configured to engage with a pinion (5) connected to a shaft of the motor, and the cogwheel having a larger dimension than the pinion.

12. A vacuum cleaner, comprising:

a container (101) with a suction inlet (108) and a unit (120) comprising a reversible electric motor (102) connected to a selector (130) of a direction of rotation, wherein the motor (102) is connected directly to a suction fan (103) and also connected via a speed reduction unit and an idle gear bearing to a high-pressure pump (104), and wherein the idle gear bearing is configured to transmit power to the high-pressure pump (104) when the motor rotates in a first direction, and to idle when the motor rotates in an opposite second direction.

13. The vacuum cleaner according to claim 12, wherein the motor operates the high-speed pump selectively by way of the selector of the direction of rotation.

14. The vacuum cleaner according to claim 12, wherein the idle gear bearing has a cogwheel (6) mounted thereon, the cogwheel being configured to engage with a pinion (5) connected to a shaft of the motor, and the cogwheel having a larger dimension than the pinion.

15. The vacuum cleaner according to claim 12, further comprising:

an air compressor (10) in connection with the motor via a belt and a magnetic clutch (11).

* * * * *

UNITED STATES PATENT AND TRADEMARK OFFICE

CERTIFICATE OF CORRECTION

PATENT NO. : 8,720,000 B2
APPLICATION NO. : 12/374834
DATED : May 13, 2014
INVENTOR(S) : Marino Pedrazzini Bertolazzi It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 799 days.

Signed and Sealed this
Twenty-ninth Day of September, 2015

Michelle K. Lee

Michelle K. Lee
*Director of the United States Patent and Trademark Office*